US011327430B2

(12) United States Patent
Kitajima

(10) Patent No.: US 11,327,430 B2
(45) Date of Patent: May 10, 2022

(54) IMAGE FORMING DEVICE WITH CONNECTED ACCOMMODATING PORTIONS FOR CONTROL BOARD AND RECORDING MEDIA

(71) Applicant: CANON KABUSHIKI KAISHA, Tokyo (JP)

(72) Inventor: Tomoharu Kitajima, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/338,588

(22) Filed: Jun. 3, 2021

(65) Prior Publication Data

US 2021/0389716 A1 Dec. 16, 2021

(30) Foreign Application Priority Data

Jun. 11, 2020 (JP) ..... JP2020-101629

(51) Int. Cl.
*G03G 15/00* (2006.01)
*G03G 21/16* (2006.01)

(52) U.S. Cl.
CPC ..... *G03G 21/1633* (2013.01); *G03G 15/80* (2013.01); *G03G 21/1619* (2013.01); *G03G 21/1647* (2013.01); *G03G 21/1652* (2013.01)

(58) Field of Classification Search
CPC ..... G03G 15/80; G03G 21/1619; G03G 21/1633; G03G 21/1647; G03G 21/1652; B41J 29/02
See application file for complete search history.

(56) References Cited

U.S. PATENT DOCUMENTS

| | | | | |
|---|---|---|---|---|
| 10,423,093 | B2 | 9/2019 | Hara | G03G 15/30 |
| 2017/0131680 | A1* | 5/2017 | Koseki | G03G 21/1619 |
| 2017/0364015 | A1* | 12/2017 | Yoshino | G03G 15/80 |
| 2018/0103542 | A1* | 4/2018 | Shinotsuka | G03G 15/80 |
| 2019/0094744 | A1 | 3/2019 | Hara | G03G 15/30 |

FOREIGN PATENT DOCUMENTS

JP 2019-059085 4/2019

* cited by examiner

*Primary Examiner* — Sophia S Chen
(74) *Attorney, Agent, or Firm* — Venable LLP

(57) ABSTRACT

An image forming apparatus includes an electric board extending to a first direction and a second direction, a board accommodating portion cover the electric board, a recording medium accommodating portion to cover a recording medium and a connecting portion. The recording medium accommodating portion is arranged side by side with the board accommodating portion in the first direction. The connecting portion is arranged to overlap with the board accommodating portion and the recording medium accommodating portion as seen in a third direction perpendicular to the first and second directions, and connects the board accommodating portion and the recording medium accommodating portion. The board accommodating portion and the recording medium accommodating portion are directly fixed to the connecting portion, respectively.

10 Claims, 9 Drawing Sheets

IMAGE FORMING DEVICE WITH CONNECTED ACCOMMODATING PORTIONS FOR CONTROL BOARD AND RECORDING MEDIA

FIELD OF THE INVENTION AND RELATED ART

The present invention relates to an image forming apparatus that forms images on sheets.

Conventionally, the image forming apparatus equipped with a controller box inside an outer cover on the back of the apparatus has been proposed (Japanese Laid-Open Patent Application (JP-A) 2019-59085). In this controller box, an HDD unit is fixed by screws.

However, in the image forming apparatus described in JP-A 2019-59085, the controller box and the HDD unit are stacked in the front and back direction, which makes the apparatus larger. Meanwhile, if the controller box and the HDD unit are lined up in a plane and directly connected, the rigidity of the connecting surface is decreased.

An object of the present invention is to provide an imaging forming apparatus capable of arranging a board accommodating portion and a recording medium accommodating portion in a compact manner and with a higher rigidity of a connecting surface than conventional technologies.

SUMMARY OF THE INVENTION

The present invention relates to an image forming apparatus for forming an image on a sheet, comprising an electrical board extending in a first direction and a second direction perpendicular to the first direction, a board accommodating portion configured to incorporate said electric board so as to cover said electric board, a recording medium extending in the first direction and second direction, a recording medium accommodating portion, arranged side by side with said board accommodating portion in the first direction, configured to incorporate said recording medium so as to cover said recording medium, and a connecting portion, arranged to overlap with said board accommodating portion and said recording medium accommodating portion as seen in a third direction perpendicular to the first direction and the second direction, configured to connect said board accommodating portion and said recording medium accommodating portion, wherein said board accommodating portion and said recording medium accommodating portion are directly fixed to said connecting portion, respectively.

According to the present invention, a board accommodating portion and a recording medium accommodating portion can be arranged compactly and with a high rigidity. Further features of the present invention will become apparent from the following description of exemplary embodiments (with reference to the attached drawings).

BRIEF DESCRIPTION OF THE DRAWINGS

Part (a) of FIG. 1 is an overall schematic view showing a printer according to a present embodiment. Part (b) of FIG. 1 is a schematic view showing an image forming station.

Figure 3:
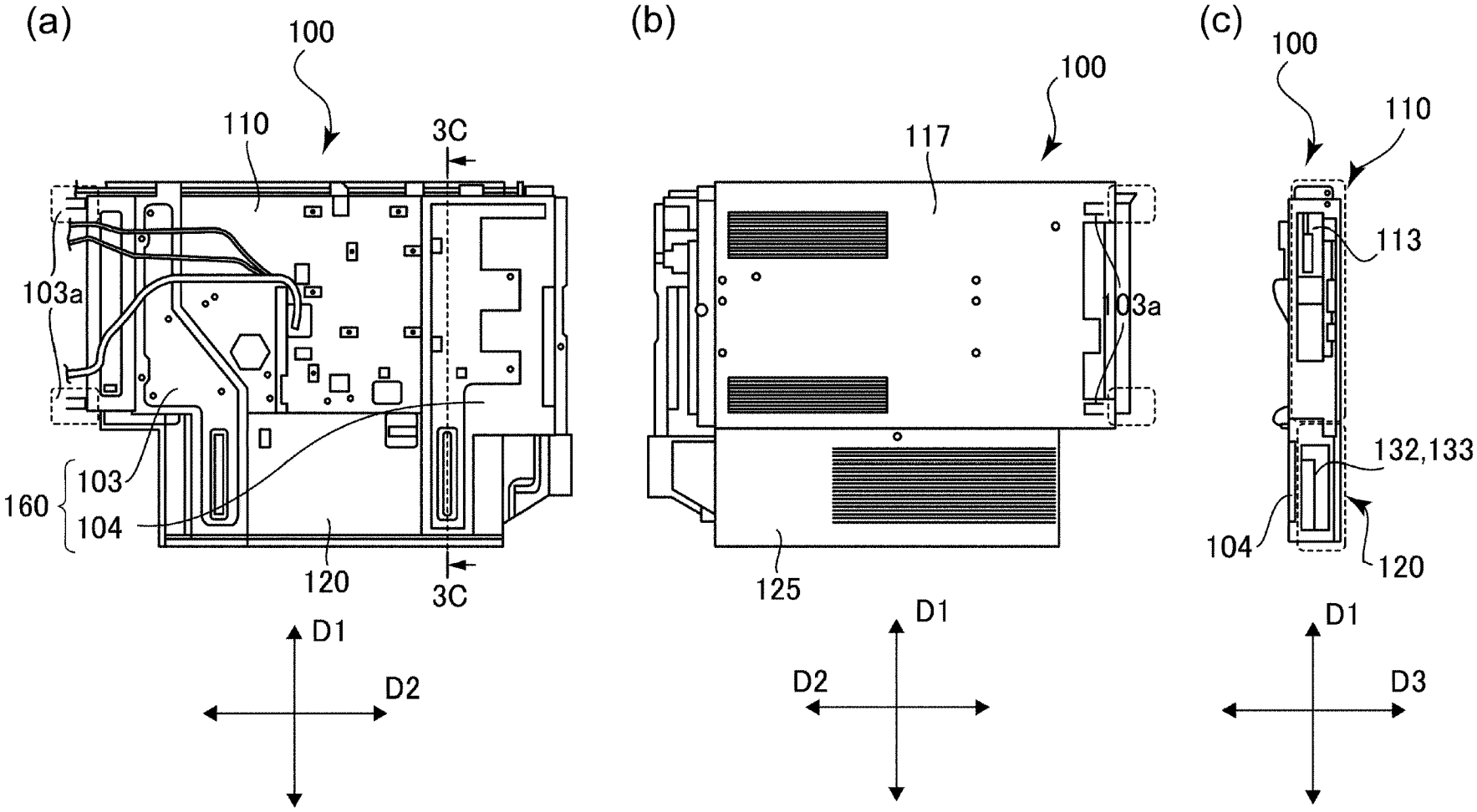

Part (a) of FIG. 3 is a front view showing a controller box unit. Part (b) of FIG. 3 is a back view showing the controller box unit. Part (c) of FIG. 3 is a sectional view showing a 3C-3C section of Part (a) of FIG. 3.

Figure 4:
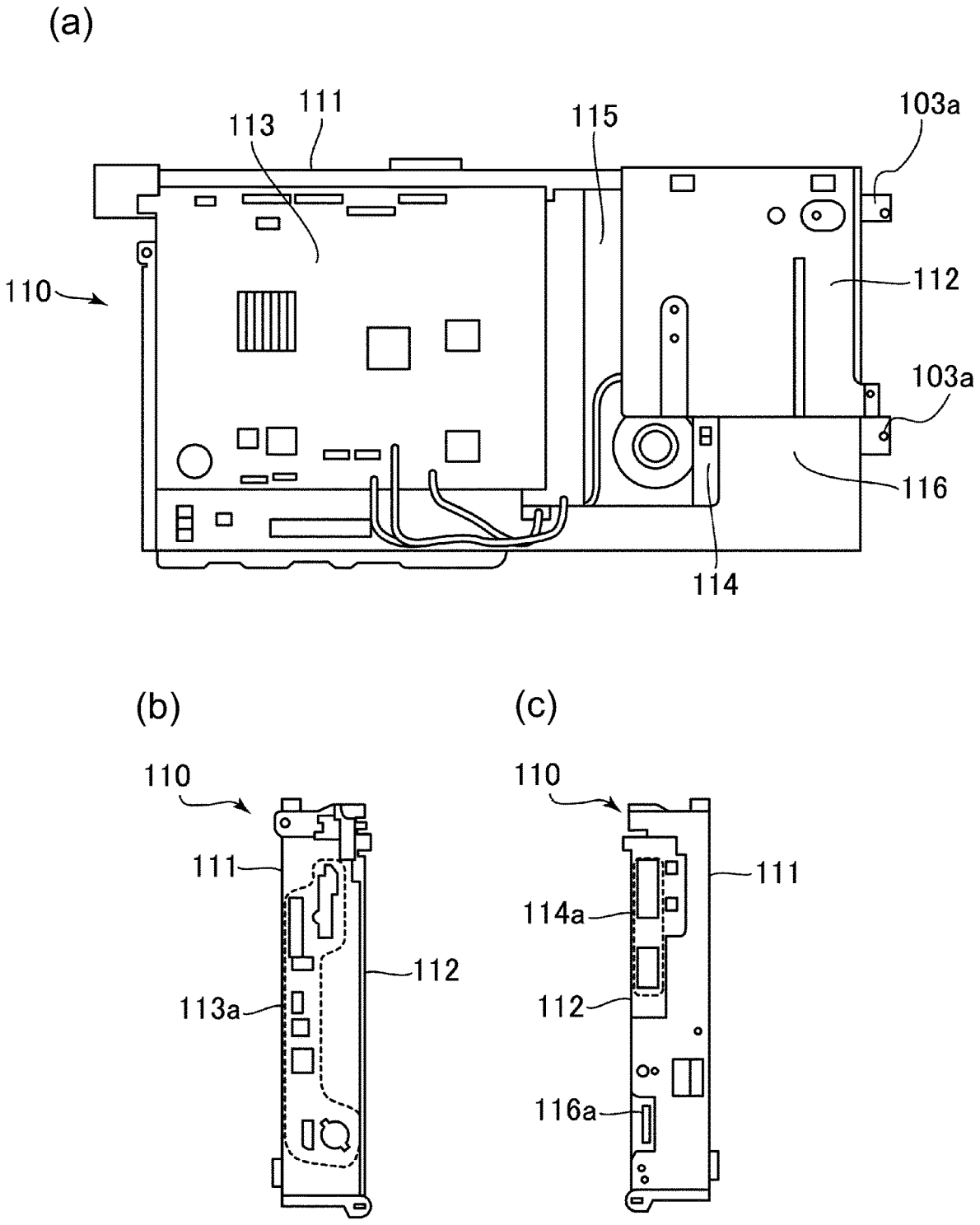

Part (a) of FIG. 4 is a back view showing a board accommodating portion. Part (b) of FIG. 4 is a right-side view showing a board accommodating portion. Part (c) of FIG. 4 is a left-side view showing a board accommodating portion.

Figure 5:
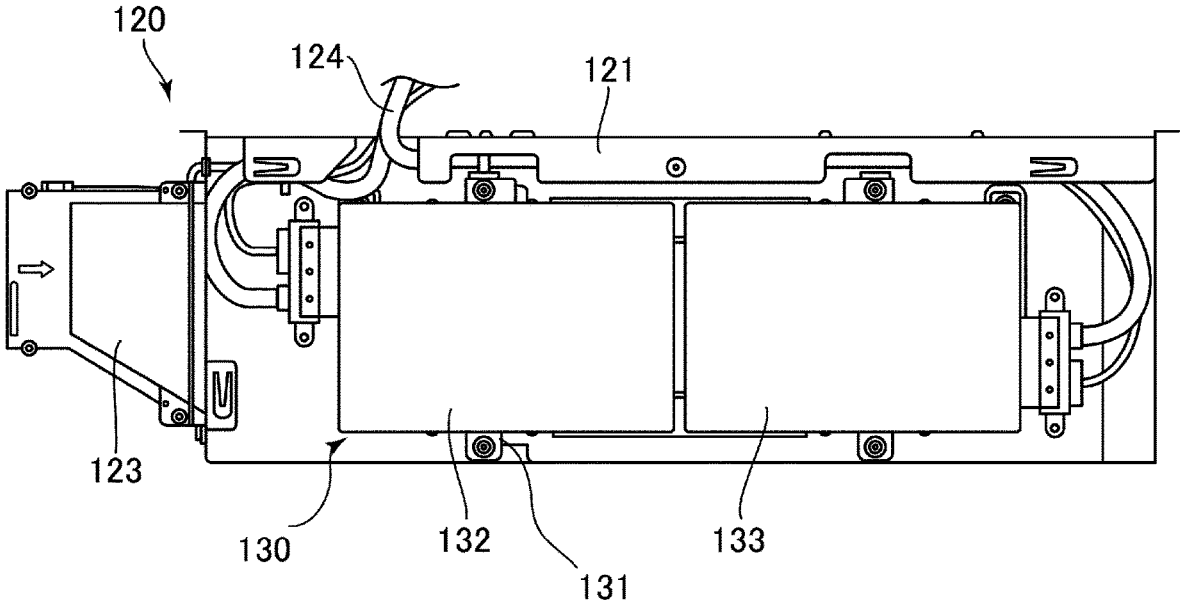

FIG. 5 is a front view showing a recording medium accommodating portion.

Figure 6:
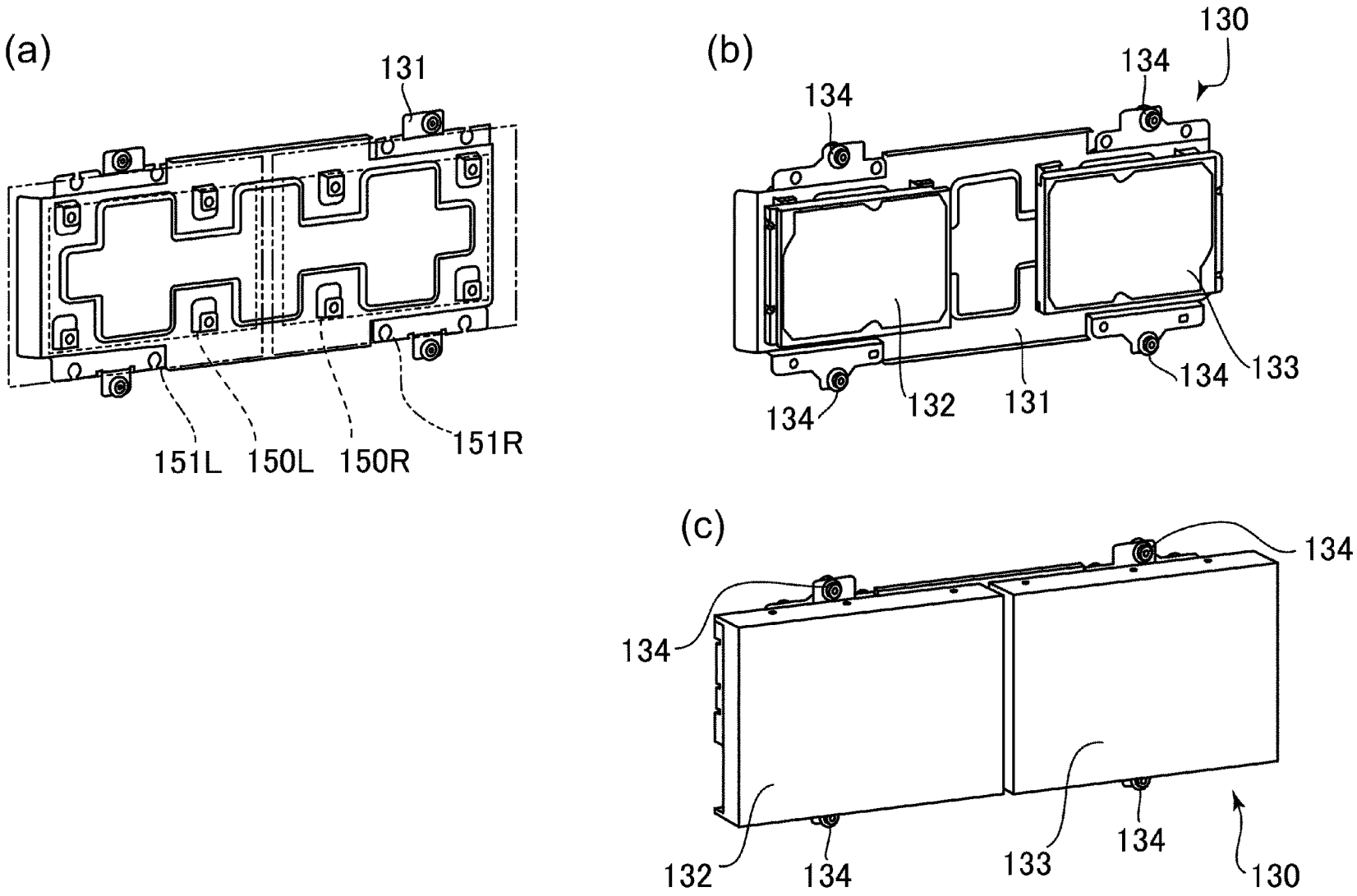

Part (a) of FIG. 6 is a perspective view showing a recording medium holder of a recording medium holding unit. Part (b) of FIG. 6 is a perspective view showing a state that 2.5-inch HDDs or SSDs are attached to the recording medium holder. Part (c) of FIG. 6 is a perspective view showing a state that 3.5-inch HDDs are attached to the recording medium holder.

Figure 7:
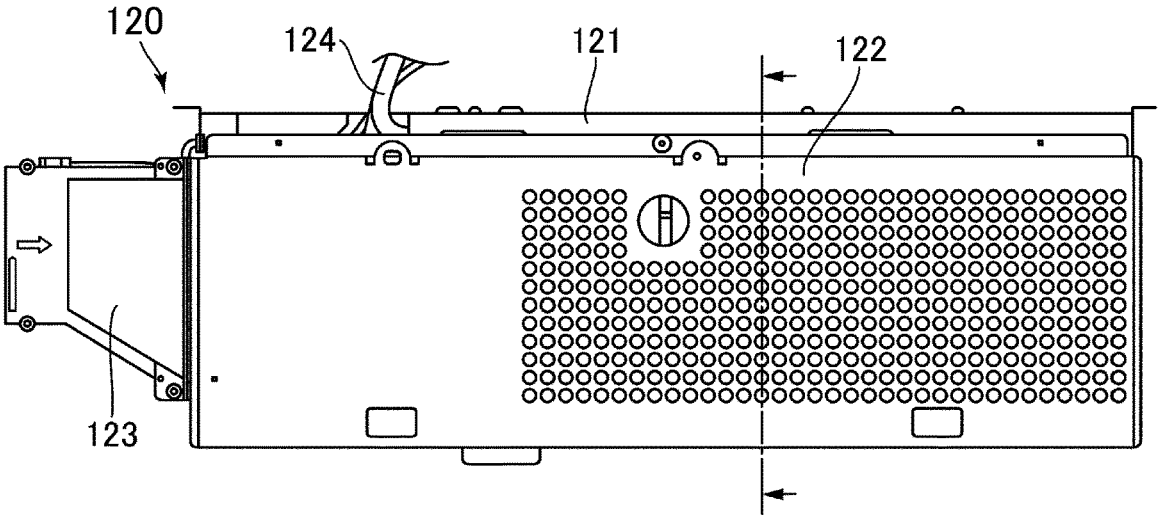

FIG. 7 is a front view showing a state that a recording medium accommodating portion cover is assembled to a recording medium accommodating case.

Figure 8:
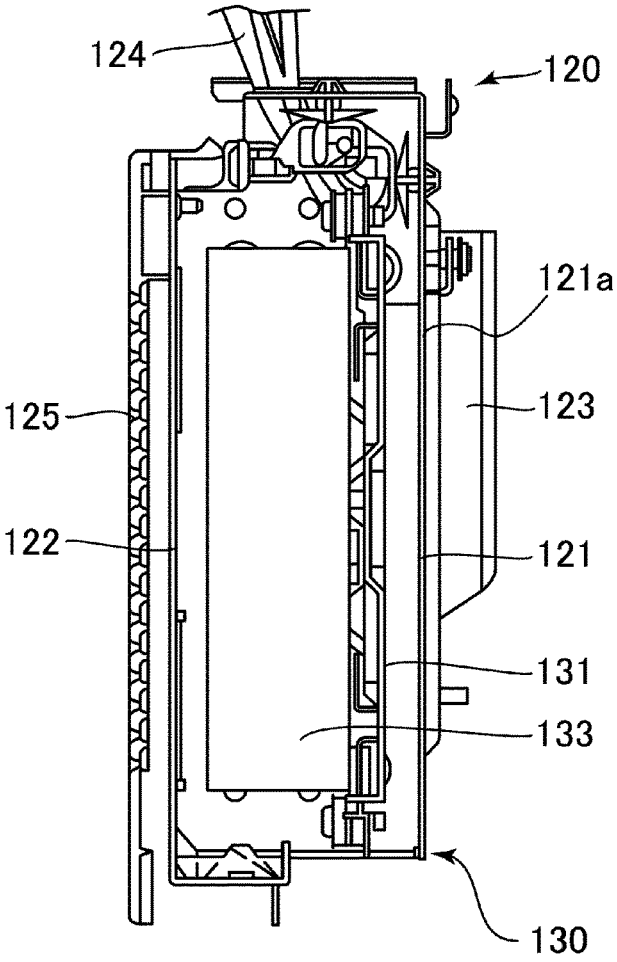

FIG. 8 is a sectional view showing a state that a recording medium accommodating potion cover and an outer cover are assembled to a recording medium accommodating portion case.

Figure 9:
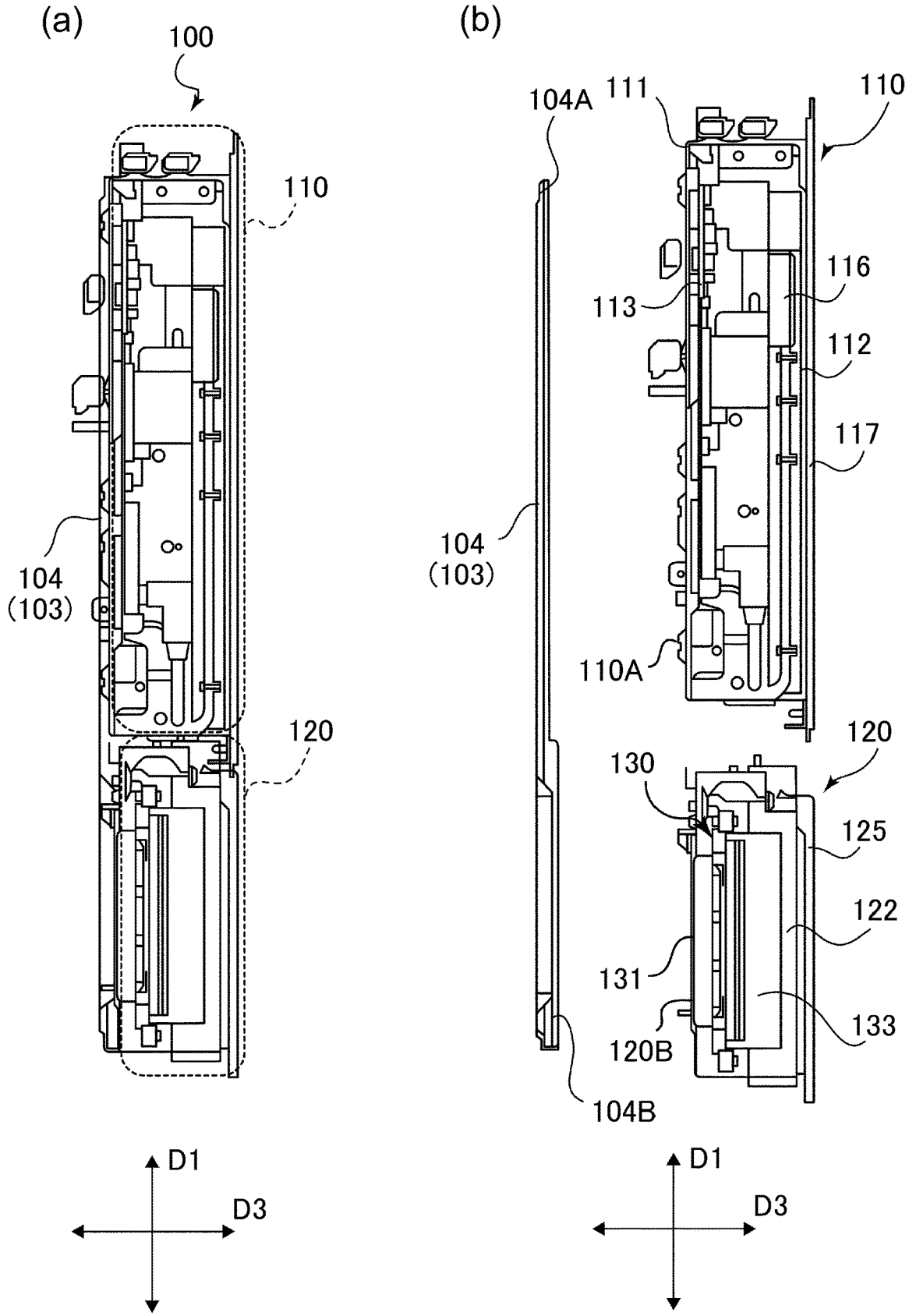

Part (a) of FIG. 9 is a sectional view showing a state that a board accommodating portion and a recording medium accommodating portion are assembled to a support plate. Part (b) of FIG. 9 is a sectional view showing a state before a board accommodating portion and a recording medium accommodating portion are assembled to a support plate.

Figure 10A:
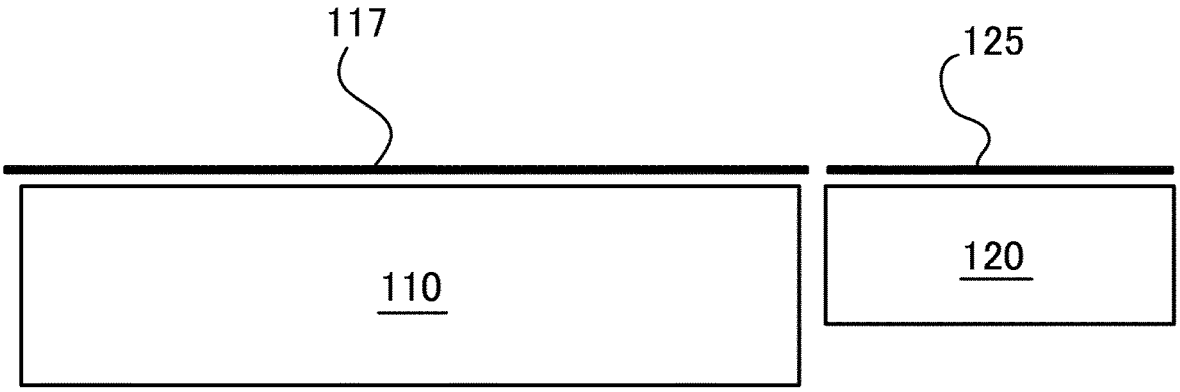
Figure 10B:
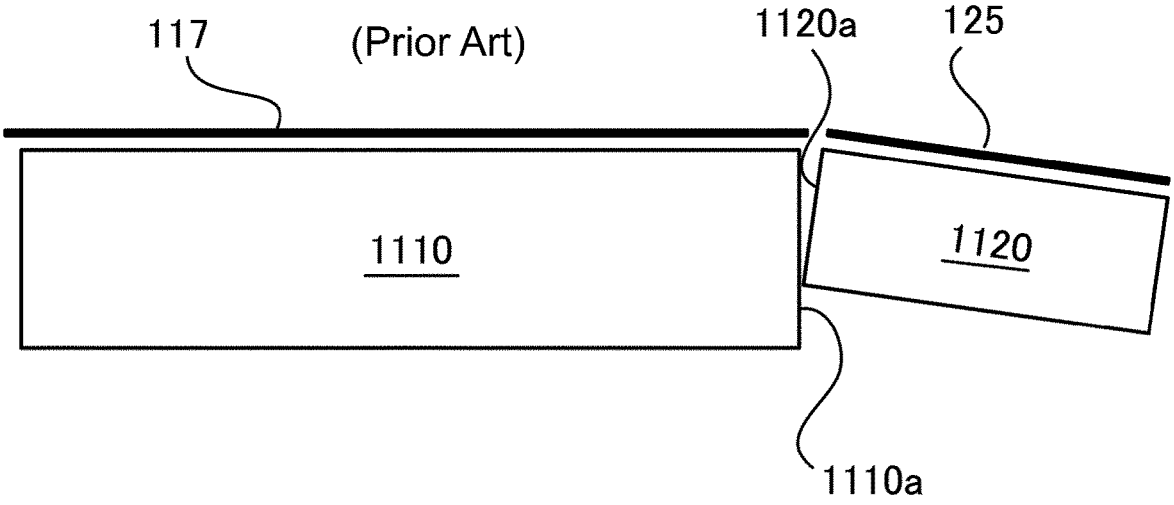

FIG. 10(*a*) is a schematic view showing an arrangement relationship of a board accommodating portion, a recording medium accommodating portion, and an outer cover in this embodiment. FIG. 10(*b*) is a schematic view showing an arrangement relationship of a board accommodating portion, a recording medium accommodating portion, and an outer cover in a comparison example.

DESCRIPTION OF THE EMBODIMENTS

[Overall Configuration]

A front side in this embodiment of printer 1 is a side where a user faces an apparatus directly, and a back side is an opposite side. A forward direction is a direction from a back side to a front side, and a backward direction is a direction from a front side to a back side. Left and right are a left side and a right side of a printer as viewed from a front side. A left direction is a direction from a right side to a left side, and a right direction is a direction from a left side to a right side. Up and down is up and down in a direction of gravity. An upward direction is a direction from bottom to top, and a downward direction is a direction from top to bottom.

A printer 1 as an image forming apparatus in a first embodiment is an electrophotographic laser beam printer. As shown in part (a) of FIG. 1, the printer 1 has an image forming portion 3 which forms images on a sheet P, a feeding portion 5, and a fixing portion 7.

The image forming portion 3 includes four image forming stations SY, SM, SC and SK, an intermediary transfer unit 31, and a laser scanner LS. The four image forming stations SY, SM, SC and SK have the same configuration except that colors of images to be formed are different. Therefore, only the configuration and image forming process of the image forming station SY will be described, and description of the other image forming stations will be omitted.

Figure 1:
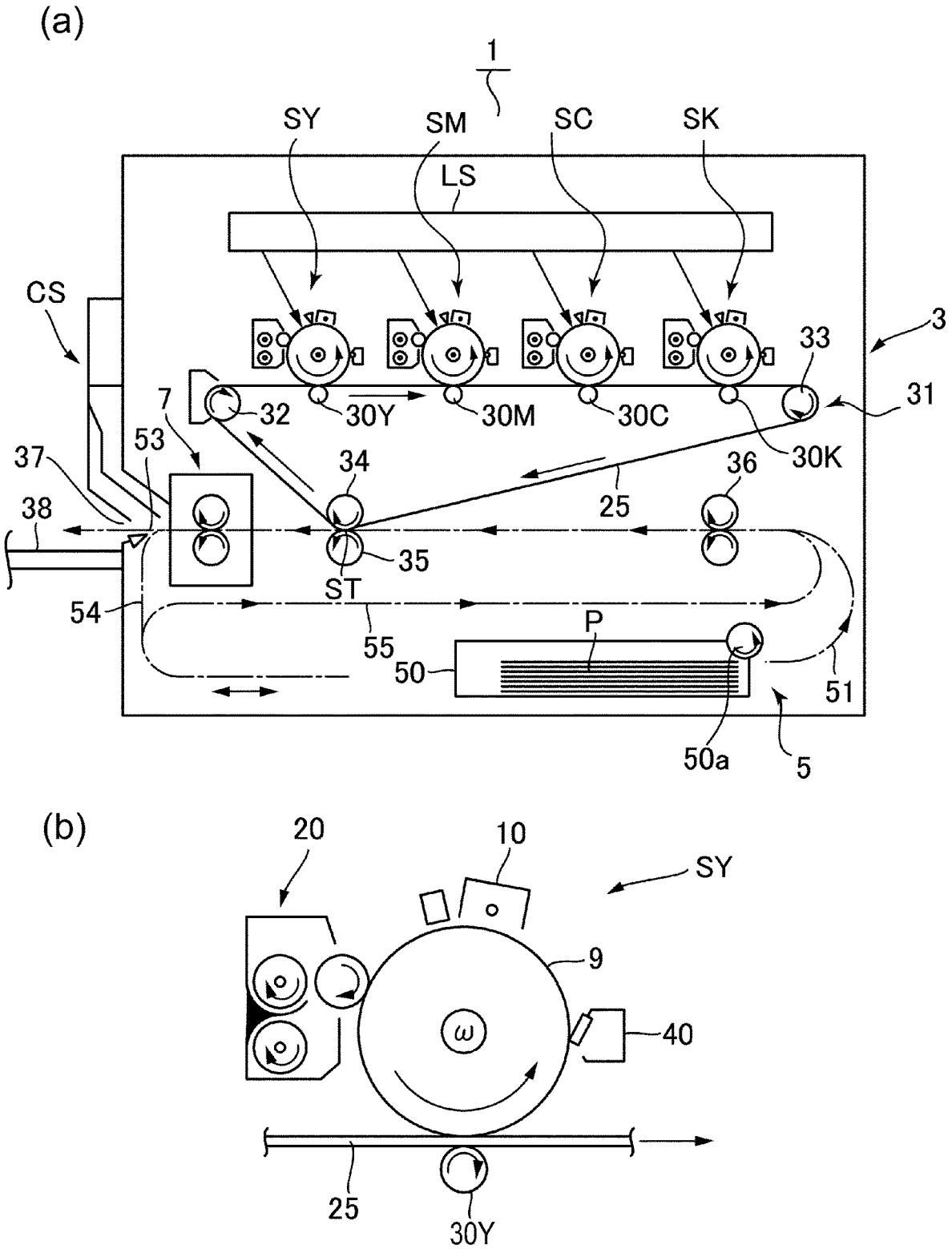

The image forming station SY includes a photosensitive drum 9, a charging device 10, a developing device 20, and a cleaning device 40, as shown in part (b) of FIG. 1. The photosensitive drum 9 consists of an aluminum cylinder with an organic photoconductive layer applied to its outer circumference and rotates around a rotation axis extending in the front and back direction by an unshown driving motor. The cleaning device 40 includes a cleaning blade in sliding contact with the photosensitive drum 9 and cleans toner that has not been fully transferred from the photosensitive drum 9. In this embodiment, the charging device 10 consists of a corona charger, but any other type of charger may be possible.

As shown in part (a) of FIG. 1, the intermediary transfer unit 31 includes an intermediary transfer belt 25, which is wound around a driving roller 32, a tension roller 33 and an inner secondary transfer roller 34 etc. Primary transfer rollers 30Y, 30M, 30C and 30K are provided inside the intermediary transfer belt 25. A secondary transfer roller 35 is provided opposite the inner secondary transfer roller 34 so as to nip the intermediary transfer belt 25, and the intermediary transfer belt 25 and the secondary transfer roller 35 form a transfer nip ST that an image is transferred to the sheet P being fed.

A feeding portion 5 is provided in the lower part of the printer 1, and includes a cassette 50 which supports a sheet P and a pickup roller 50*a* which feeds the sheet P supported by the cassette 50. A fixing portion 7 includes a fixing roller and a pressure roller that are formed in hollow shapes. Inside the fixing roller, an unshown heater and a temperature sensor which measures the temperature of the heater are incorporated.

An image forming operation of the printer 1 will be described. If an image data read by a personal computer or an unshown reading device is input to the laser scanner LS, laser light corresponding to the image data is emitted from the laser scanner LS onto the photosensitive drum 9 of the image forming station SY.

At this time, the surface of the photosensitive drum 9 is uniformly charged to a predetermined polarity and potential in advance by the charging device 10, and an electrostatic latent image is formed on the surface by emitting a laser beam from the laser scanner LS. The electrostatic latent image formed on the photosensitive drum 9 is developed by the developing device 20 to form a yellow (Y) toner image on the photosensitive drum 9.

In the same way, toner images of magenta (M), cyan (C) and black (K) are formed by the developing device after laser light is emitted from a laser scanner LS to each photosensitive drum in the imaging stations SM, SC and SK. Each toner image of each color formed on each photosensitive drum is transferred to an intermediary transfer belt 25 by primary transfer roller 30Y, 30M, 30C or 30K, and is fed to transfer nip ST by the intermediary transfer belt 25 rotated by a drive roller 32. An image forming process for each color is performed at a timing to superimpose an image on the upstream toner image that has been primary transferred onto the intermediary transfer belt 25. The toner remaining on a photosensitive drum 9 after the toner image is transferred is collected by a cleaning device 40.

In parallel with the image forming process, the sheet P stored in the cassette 50 of the feeding portion 5 is fed into a feeding path 51 by a pickup roller 50*a*. The sheet P is corrected for skewness in a registration roller pair 36, and is fed at a predetermined feeding timing in accordance with the transfer timing of the image in the transfer nip ST.

A full-color toner image on the intermediary transfer belt 25 is transferred to the sheet P in the transfer nip ST by secondary transfer bias applied to the secondary transfer roller 35. The sheet P on which the toner image has been transferred is subjected to predetermined heat and pressure by a fixing roller and a pressure roller in the fixing portion 7, and the toner is melted and fixed. The sheet P which has passed through the fixing portion 7 is cooled by a cooling device CS in a discharge path 53 and discharged from a discharge port 37 to a discharge tray 38.

If a double-side printing job in which images are formed on both sides of a sheet is input, the sheet P that an image has been formed on a first side and passed through the fixing portion 7 is guided to a reversing path 54. The sheet P, which is switched back in the reversing path 54, is fed through a double-side feeding path 55. The sheet P joins the feeding path 51 from the double-side feeding path 55, an image is formed on a second side similarly to the first side, and the sheet P is discharged into the discharge tray 38.

[Electrical Component]

An electrical component of the printer 1 will be described. In the printer 1, a user operation system is set up together on the front side of the main assembly so that a user does not have to go around the imaging forming apparatus and operate it from the back side of the apparatus in such case that a user needs to operate it for recovery from a jam. For this reason, it is common that a driving system which transmits power to each portion of the apparatus and an electrical system which performs electrical control are arranged together on the back side of the main assembly. The electrical system of the printer 1 consists of AC and DC power supply systems, various boards for high voltage systems, control system boards, driving system boards, and wires that electrically connect them.

Figure 2:
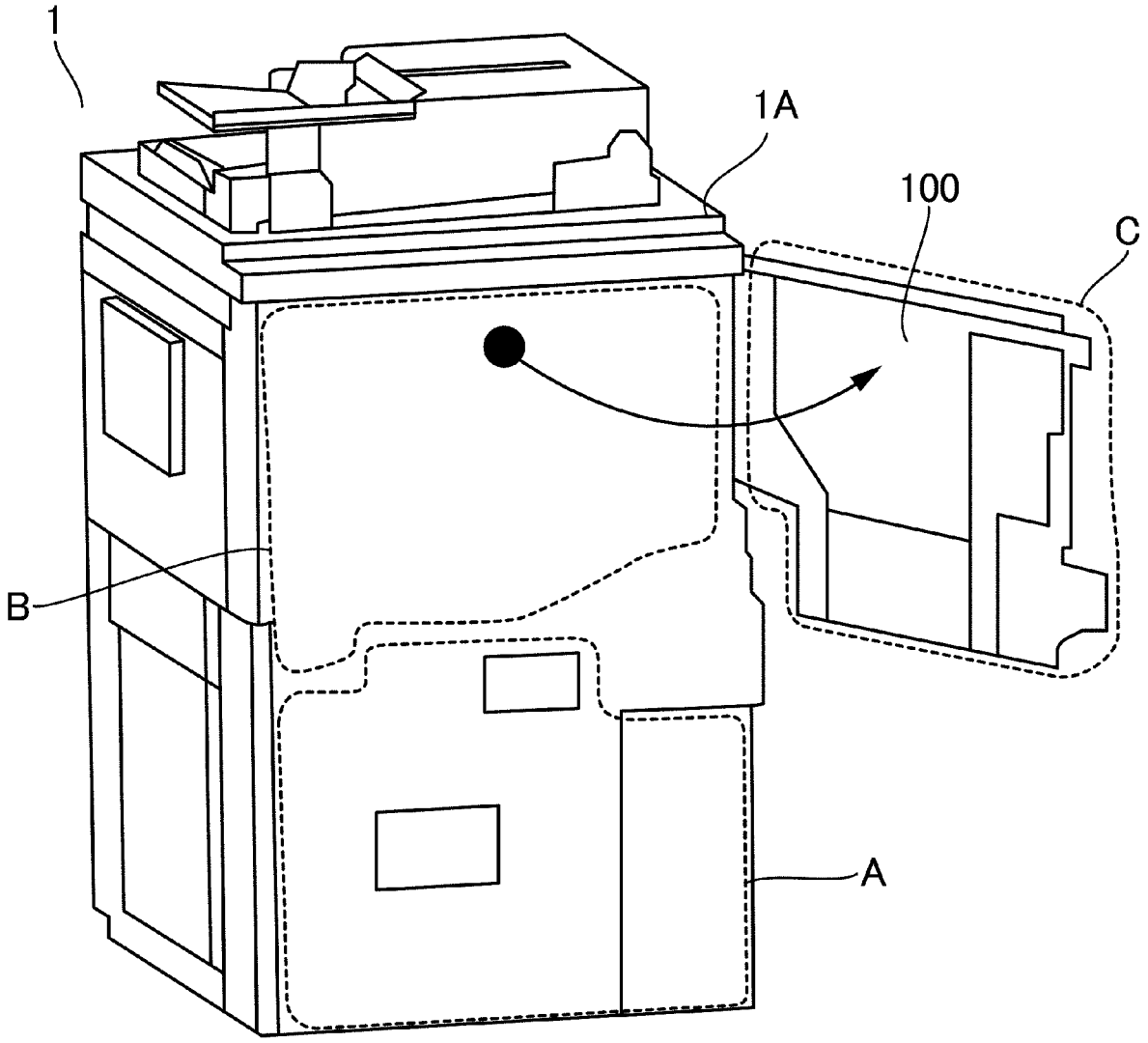
FIG. 2 is a perspective view showing an electrical component of a printer.

A power supply system unit is a relatively heavy unit because a power supply system board contains relatively heavy items such as transformers and are shielded by metal plates because they are noise sources. A power cord is connected to the power supply system unit to supply power from an external outlet. The power cord is relatively heavy due to its thick safety coating, so if the connection point is set above the main assembly, the weight of the power cord acts on the connection part of the power cord in the direction of disconnection. So, it is desirable to arrange the power supply system unit in the lowest area of the main assembly to lower the center of gravity of the main assembly and increase the stability of installation from the viewpoint of stability of the power cord contact point and prevention of the main assembly from tipping over. Therefore, in the printer 1, the power supply system unit is arranged in area A, as shown in FIG. 2. In FIG. 2, the printer 1 has an image reading device at the top, but it may not have an image reading device.

It is desirable to arrange a high-voltage system board, a control system board, and a drive system board close to their respective loads to shorten lengths of bundled cables, and it is desirable to arrange them around the image forming portion in the printer 1. Therefore, in the printer 1, the high-voltage system board, the control system board, and the driving system board are arranged in area B.

The board accommodating portion is where the boards, which are particularly vulnerable to radiated noise among all electrical component units, are stored together. In the board accommodating portion, a housing is made of metal plates to enclose and shield boards that are vulnerable to radiated noise, and the housing is electrically conductive to a body frame to keep noise resistance by matching GND levels of the housing and the body frame. A recording medium (HDD, etc.) built in the main assembly is integrated into the board accommodating portion in order to communicate with a controller board. The board accommodating portion is arranged in the relatively upper part of the printer 1, where is the remaining area after other electrical component units are priorly arranged. In other words, the board accommodating portion is arranged in area C.

In this embodiment, the board accommodating portion and the recording medium accommodating portion, which will be described later, are integrally accommodated in a controller box unit 100 and are arranged at an upper back of a main assembly 1A of the printer 1. The controller box unit 100, as an open and close unit, is supported so that it can open and close the main assembly 1A.

[Configuration of Controller Box Unit]

The configuration of the controller box unit 100 will be explained using FIG. 3, parts (a) to (c). Part (a) of FIG. 3 shows the controller box unit 100 viewed from the front side of the main assembly, and Part (b) of Figure shows the controller box unit 100 viewed from the back side of the main assembly. Part (c) of FIG. 3 is a sectional view showing a 3C-3C section of Part (a) of FIG. 3. A left and right direction D2 as the second direction is perpendicular to a up and down direction D1 as the first direction, and a front and back direction D3 as the third direction is perpendicular to the up and down direction D1 and the left and right direction D2. The left and right direction D2 is an example of horizontal directions.

The controller box unit 100 includes a hinge portion 103*a* which supports the controller box unit 100 in the way that it can open and close the main assembly 1A, and open and close in the horizontal direction around an axis extending in the vertical direction D1. The controller box unit 100 is electrically connected to the main assembly 1A via various harness cables and is configured to be able to operate even when it is opened against the main assembly 1A.

This is because a service person may perform maintenance of the printer 1 with the controller box unit 100 open as a customer service, and it is useful, for example, for initial diagnosis of a defective object. And by configuring the controller box unit 100 so that it can be opened and closed, an electrical component portion and driving system parts in the main assembly 1A, which are arranged adjacent to the controller box unit 100, can be easily accessed.

The controller box unit 100 is fixed with screws to the main assembly 1A in the closed state. Thus, a screw-fixed portion, a hinge rotation portion, and upper and lower gasket portions have electrical conductivity with the housing of the main assembly 1A, and radiation noise is prevented. The controller box unit 100 and the main assembly 1A are fixed by screw at only one point, which improves assembly workability and service workability. The printer 1 is normally operated with the controller box unit 100 closed.

The controller box unit 100 includes the board accommodating portion 110, the recording medium accommodating portion 120, and the support plates 103 and 104, as shown in FIG. 3 Part (a) to (c). The board accommodating portion 110 and the recording medium accommodating portion 120 extend in the vertical direction D1 and the left and right direction D2 respectively and are directly fixed by screws to the support plates 103 and 104 to be integrated. The recording medium portion 120 is arranged alongside the board accommodating portion 110 in the vertical direction, and since the board accommodating portion 110 and the recording medium portion 120 are arranged without being stacked in the front and back direction D3, the printer 1 can be made compact in the front and back direction D3. The support plate 103 has the hinge portion 103*a*. The support plates 103 and 104, as the first connecting members and the second connecting members respectively, configure the connecting portion 160.

The board accommodating portion 110 forms an independent closed space enclosed by metal plates and incorporates a controller board 113 as an electrical board so as to cover it. Likewise, the recording medium accommodating portion 120 forms an independent closed space enclosed by metal plates and incorporates recording mediums 132 and 133 such as HDD to be covered.

An outer cover 117 as a first outer cover is attached to the board accommodating portion 110, and an outer cover 125 as a second outer cover is attached to the recording medium accommodating portion 120. These outer covers 117 and 125 can be removed independently even when the board accommodating portion 110 and the recording medium accommodating portion 120 are integrated, and configure the outer of the controller box unit 100. The board accommodating portion 110 and the recording medium accommodating portion 120 can be easily accessed by removing the outer covers 117 and 125 even when the controller box unit 100 is closed.

[Configuration of a Board Accommodating Portion]

The configuration of the board accommodating portion 110 will be described using FIG. 4, parts (a) to (c). Part (a) of FIG. 4 shows the board accommodating portion 110 viewed from the back side of the main assembly. Part (b) of FIG. 4 shows the right side of the board accommodating portion 110, and Part (c) of FIG. 4 shows the left side of the board accommodating portion 110.

The board accommodating portion 110 includes a U-shaped section housing 111 to which the built-in boards are attached, and a cover member 112 covering the opening of the housing 111, and then an effect of radiated noise on the built-in boards is reduced. In part (a) of FIG. 4, only a part of the cover member 112 is shown.

The board accommodating portion 110 mainly incorporates a controller board 113, FAX units 114 and 115, and an external controller connection unit 116. The board accommodating portion 110 is equipped with an external interface terminal 113*a*, a modular jack 114*a*, and a connector terminal 116*a*. The external interface terminal 113*a* is used to electrically connect the controller board 113 to an external device such as a finisher that is integrated with the main assembly 1A to build an image forming system. The modular jack 114*a* is for connecting the FAX units 114 and 115 to a FAX line cable. The connector terminal 116*a* is for connecting the external controller connection unit 116 to an external controller.

The controller board 113 is arranged closer to the right side of the board accommodating portion 110, and holes are formed on the right side of the board accommodating portion 110 to allow access to the external interface terminal 113*a*. The service person accesses the external interface terminal 113*a* to set various options such as billing options and USB to meet needs of each user when the printer 1 is installed in the market. And by concentrating the external interface terminals 113*a* on one side of the board accommodating portion 110, workability is improved.

The FAX units 114 and 115 and the external controller connection unit 116 are arranged on the left side of the controller board 113. Holes are formed on the left side of the board accommodating portion 110 to allow access to said modular jacks 114*a* and said connector terminal 116*a*, respectively.

The external controller connection unit 116 is an additional option product to be installed later, and from the viewpoint of easy installation as the option product in the market, it is configured so that it can be assembled later to the board accommodating portion 110 with the FAX unit 114 attached. From the viewpoint of easy installation as the optional product in the market, it is ideal that all the mounted units are laid flat on the board accommodating portion 110 and no assembly order is needed.

However, this way has disadvantages of increasing the projected area of the board accommodating portion 110 and making the printer 1 larger or increasing the size and weight of the housing 111 of the board accommodating portion 110. For this reason, it is desirable to make the board accommodating portion 110 as compact as possible. In other words, it is better to make the board accommodating portion 110 as compact as possible and give priority to stacking the mounted units in a narrow space, rather than making the board accommodating portion 110 so large that all the mounted units can be laid flat in the board accommodating portion 110.

[Configuration of Recording Medium Accommodating Portion]

The recording medium used in the printer 1 is either a 2.5-inch HDD, a 3.5-inch HDD or SSD, and there are different variations depending on productivities and user requirements. The recording medium plays a role of installing an operating system to start up the printer 1 and an application software, a data storage for the application software, and a temporary storage of image data. Especially, as for reading and writing image data, a 3.5-inch HDD or SSD capable of high-speed communication is mounted in a high-speed printer to match a productivity of the printer 1. A 3.5-inch HDD generates a large amount of heat for driving, so it is necessary to cool them by forcefully blowing cooling air by a dedicated fan onto the 3.5-inch HDD. A 2.5-inch HDD and an SSD generate less heat, so they do not require fan cooling airflow.

At least one recording medium is sufficient for operations of printer 1. However, in case that continuous operations of the printer 1 are important, another recording medium is installed and used as mirroring, and when one recording medium (master one) fails, the operation can be immediately switched to the other recording medium (slave one) to ensure continuous operations of the printer 1. To meet this need, the printer 1 can be equipped with two recording media, and a second mirroring recording media is available as an option. Since recording media are consumable devices, it is desired that they are easy to access and replace.

As described above, the recording medium accommodating portion 120 has three default settings: "a 2.5-inch HDD", "an SSD", or "a 3.5-inch HDD and a cooling fan". In addition, each type of recording medium (a 2.5-inch HDD, a 3.5-inch HDD, and an SSD) is set as an option, and one recording medium of the same type as the master one can be added to the recording medium accommodating portion 120.

Next, a configuration of the recording medium accommodating portion 120 will be described in detail using from FIG. 5 to FIG. 8. As shown in FIG. 5, the recording medium accommodating portion 120 includes the recording medium accommodating portion case 121, the recording medium holding unit 130 supported by the recording medium accommodating portion case 121, and the cooling fan unit 123. In this embodiment, a 3.5-inch HDD that requires a cooling fan is applied as a recording medium, but in case that a 3.5-inch HDD is not used, the cooling fan unit 123 may be omitted.

Part (a) of FIG. 6 is a perspective view showing only the recording medium holder 131 of the recording medium holding unit 130. Part (b) of FIG. 6 is a perspective view showing a state that 2.5-inch HDDs or an SSDs are attached to the recording medium holder 131 as recording medium 132 and 133. Part (c) of FIG. 6 is a perspective view showing a state that 3.5-inch HDDs are attached to the recording medium holder 131 as the recording medium 132 and 133.

As shown in FIG. 6, parts (a) to (c), the recording medium holding unit 130 consists of the recording medium holder 131 to which the recording medium 132 and 133 are fixed with screws. As shown in part (a) of FIG. 6, the recording medium holder 131 includes left and right holding areas 150L and 150R (indicated by dashed lines) where 2.5-inch HDDs or SSDs are fixed, and left and right holding areas 151L and 151R (indicated by two-dotted chain lines) where 3.5-inch HDDs are fixed. Thus, the recording medium holder 131 is configured to hold two recording media of any type of 2.5-inch HDDs, SSDs and 3.5-inch HDDs.

In general, since HDDs are susceptible to vibration, the recording medium holder 131 is fixed with screws to the recording medium accommodating portion case 121 via an elastic member 134 which is made of rubber or other material. Thus, the recording media 132 and 133 supported by the recording medium holder 131 are provided so that they are less susceptible to vibrations during operation and transportation of the printer 1.

The assembly procedure of the recording medium accommodating portion 120 is as follows. As shown in FIG. 5, the recording medium holding unit 130 is built into the recording medium accommodating portion case 121. A recording medium connection cable 124 is connected to the recording media 132 and 133 in the recording medium holding unit 130. As shown in FIG. 7 and FIG. 8, a recording medium accommodating portion cover 122 is assembled to the recording medium accommodating portion case 121, and the recording media 132 and 133 are covered by the recording medium accommodating portion case 121 and the recording medium accommodating portion cover 122.

The outer cover 125 is fixed to the recording medium accommodating portion cover 122 with a single screw. Since the outer cover 125 can be detached by simply removing one screw, it is easy to access the recording medium accommodating portion 120 even if the controller box unit 100 is closed. Thus, it is easy to replace the recording media 132 and 133 in the recording medium accommodating portion 120.

A plurality of holes are formed on a mounting surface 121*a* on which the cooling fan unit 123 of the recording medium accommodating portion case 121 is mounted, the recording medium accommodating portion cover 122 and the outer cover 125. These plural holes serve as flow paths for wind or natural convection currents generated by the cooling fan unit 123, thereby improving a cooling efficiency of the recording media 132 and 133.

[Assembling a Board Accommodating Portion and a Recording Medium Accommodating Portion to a Support Plate]

Part (a) of FIG. 9 is a sectional view showing a state in which the board accommodating portion 110 and the recording medium accommodating portion 120 are assembled to the support plate 104. Part (b) of FIG. 9 is a sectional view showing a state before the board accommodating portion 110 and the recording media accommodating portion 120 are assembled to the support plate 104. FIG. 9, parts (a) and (b) show the 3C-3C sectional surface of FIG. 3.

As shown in FIG. 9, parts (a) and (b), the board accommodating portion 110 is fixed with screws to the support plate 104 with the mounting surface 110A of the board accommodating portion 110 seated on the seating surface 104A of the support plate 104. The recording medium accommodating portion 120 is fixed with screws to the support plate 104 with a mounting surface 120B of the recording medium accommodating portion 120 seated on a seating surface 104B of the support plate 104. As with the support plate 104, the board accommodating portion 110 and the recording medium accommodating portion 120 are also fixed with screws to the support plate 103.

As shown in FIG. 3, parts (a) to (c) and FIG. 9, part (a) and part (b), the board accommodating portion 110 and the recording accommodating portion 120 are arranged in line in a vertical direction D1 and are not stacked in the front and back direction D3. Thus, the controller box unit 100 and the printer 1 can be made compact in the front and back direction D3. The board accommodating portion 110 and the recording accommodating portion 120 are configured in box-shaped metal plates and electrically conductive to the housing of the main assembly 1A, and the controller board 113 and the recording media 132 and 133 are built in these shielded spaces. Thus, this reduces an effect of radiated noise on the controller board 113 and suppresses a degradation of image quality caused by disturbance of image signals. In addition, the recording media 132 and 133 can be arranged in close proximity to the controller board 113, and an accessibility to the data is improved.

The board accommodating portion 110 and the recording medium accommodating portion 120 are arranged so that they overlap the support plates 103 and 104 as viewed from the front and back direction D3, and are connected by the support plates 103 and 104. The support plates 103 and 104 are lined up with a space in the left and right direction D2. Thus, the board accommodating portion 110, the recording medium accommodating portion 120 and the support plates 103 and 104 are integrated as the controller box unit 100, and are supported so that they can be opened and closed with respect to the main assembly 1A via the hinge portion 103*a* provided on the support plate 103.

As a result, the rigidity of the controller box unit 100 is improved, and the relative mounting accuracy of the board accommodating portion 110 and the recording medium accommodating portion 120 is improved. In addition, the outer covers 117 and 125 are independently assembled to the board accommodating portion 110 and the recording medium accommodating portion 120. Therefore, the outer covers 117 and 125 can be removed independently even if the board accommodating portion 110 and the recording medium accommodating portion 120 are integrated, and for example, the recording medium accommodating portion 120 can be easily accessed only by detaching the outer cover 125. This allows for improved maintainability and workability.

Part (a) of FIG. 10 is a schematic view showing an arrangement relationship of the board accommodating portion 110, the recording medium accommodating portion 120, and the outer covers 117 and 125 in this embodiment. Part (b) of FIG. 10 is a schematic view showing an arrangement relationship of the board accommodating portion 1100, the recording medium accommodating portion 1120 and the outer covers 117 and 125 in the comparison example.

As shown in part (b) of FIG. 10, the board accommodating portion 1110 and the recording medium accommodating portion 1120 in the comparison example are directly connected to each other without the support plates 103 and 104 (see part (a) of FIG. 3). That is, a side surface 1110*a* of the board accommodating portion 1110 and a side surface 1120*a* of the recording medium accommodating portion 1120 are directly connected to each other. If the board accommodating portion 1110 and the recording medium accommodating portion 1120 are made of metal plates, the side surfaces 1110*a* and 1120*a* are normally bent side surfaces of metal parts.

Thus, if the side surfaces 1110*a*, 1120*a* are connected, a parts processing tolerance, that is, a bending tolerance, is accumulated, and a relative positional accuracy of the board accommodating portion 1110 and the recording medium accommodating portion 1120 is lowered. In addition, since the board accommodating portion 1110 and the recording medium accommodating portion 1120 are vulnerable to forces that cause them to bend, their flatness is easily lowered. Then, a flatness of the outer covers 117 and 125 attached to the board accommodating portion 1110 and the recording medium accommodating portion 1120 is also lowered and an appearance quality of them is lowered.

On the other hand, since the board accommodating portion 110 and the recording medium accommodating portion 120 in this embodiment are connected by the support plates 103 and 104, as shown in part (a) of FIG. 10, a relative mounting rigidity and mounting accuracy are satisfactory, and a flatness of the outer covers 117 and 125 is also higher. Therefore, the outer covers 117 and 125 are substantially flat, and the appearance quality of them is improved.

<Other Embodiments>

In an embodiment as described above, the board accommodation portion 110 and the recording medium accommodation portion 120 are arranged in the vertical direction D1, however, they may also be arranged in the left and right direction D2. In this case, the support plates 103 and 104 are also arranged so that they overlap the board accommodating portion 110 and the recording medium accommodating portion 120 as viewed from the front and back direction D3.

In the embodiment as described above, two support plates 103 and 104 are provided, but not limited to this. For example, only one support plate may be provided, and the board accommodating portion 110 and the recording medium accommodating portion 120 may be fixed to the support plate. Also, three or more support plates may be provided. Although the hinge portion 103*a* of the controller box unit 100 is provided on the support plate 103, it may be provided on the support plate 104. The controller box unit 100 may be configured to rotate around an axis extending in the horizontal direction.

In the embodiment as described above, the controller box unit 100 is configured to be able to open and close with respect to the main assembly 1A, but not to limited to this. For example, the controller box unit 100 may be attached so that it cannot be opened and closed with respect to the main assembly 1A, and may be configured so that the board accommodating portion 110 and the recording medium accommodating portion 120 may be accessed if the outer covers 117 and 125 is detached.

In the embodiment as described above, an electrophotographic printer 1 is used, but the present invention is not limited to this. For example, the invention may be applied to an inkjet type imaging forming apparatus that forms an image on a sheet by ejecting a liquid ink from a nozzle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-101629 filed on Jun. 11, 2020, which is hereby incorporated by reference herein in its entirety.

What is claimed is:

1. An image forming apparatus for forming an image on a sheet, said apparatus comprising:

an electric board extending to a first direction and a second direction perpendicular to the first direction;

a board accommodating portion configured to incorporate said electric board so as to cover said electric board;

a recording medium extending in the first direction and second direction;

a recording medium accommodating portion, arranged side by side with said board accommodating portion in the first direction, configured to incorporate said recording medium so as to cover said recording medium; and a connecting portion, arranged to overlap with said board accommodating portion and said recording medium accommodating portion as seen in a third direction perpendicular to the first direction and the second direction, configured to connect said board accommodating portion and said recording medium accommodating portion, wherein said board accommodating portion and said recording medium accommodating portion are directly fixed to said connecting portion, respectively.

2. An image forming apparatus according to claim 1, further comprising:

a first outer cover and a second outer cover configured to constitute an outer cover of said image forming apparatus, wherein said second outer cover is attached to said recording medium accommodating portion.

3. An image forming apparatus according to claim 2, further comprising:

a main assembly provided with an image forming portion for forming the image on the sheet, and an open/close unit configured to support by said main assembly so as to be openable and closable, wherein said open/close unit includes said board accommodating portion, said recording medium accommodating portion, said connecting portion, said first outer cover and said second outer cover, and wherein said first outer cover and said second outer cover constitutes an outer cover of said open/close unit.

4. An image forming apparatus according to claim 3, wherein said connecting portion includes a hinge portion configured to support said open/close unit to said main assembly so as to be openable and closable.

5. An image forming apparatus according to claim 1, wherein said connecting portion includes a first connecting member and a second connecting member arranged side by side with a gap in the second direction, and wherein said board accommodating portion and said recording medium accommodating portion are directly fixed to said first connecting member and said second connecting member, respectively.

6. An image forming apparatus according to claim 1, wherein the first direction is a vertical direction and the second direction is a horizontal direction.

7. An image forming apparatus according to claim 6, wherein as seen in the vertical direction, the recording medium accommodating portion is overlapped with the board accommodating portion.

8. An image forming apparatus according to claim 1, wherein the recording medium accommodating portion is a solid state drive (SSD).

9. An image forming apparatus according to claim 1, wherein the recording medium accommodating portion is a hard disk drive (HDD).

10. An image forming apparatus according to claim 1, wherein the recording medium accommodating portion includes a plurality of recording media.

* * * * *